United States Patent [19]

Huston

[11] 4,144,649

[45] Mar. 20, 1979

[54] BRICK ALIGNMENT POLE

[76] Inventor: Charles W. Huston, 6931 Waterloo Rd., NW., Canal Winchester, Ohio 43111

[21] Appl. No.: 823,605

[22] Filed: Aug. 11, 1977

[51] Int. Cl.[2] ..... G01C 15/10

[52] U.S. Cl. ..... 33/85

[58] Field of Search ..... 33/85, 86

[56] References Cited

U.S. PATENT DOCUMENTS

| | | | |
|---|---|---|---|
| 1,872,860 | 8/1932 | Winter | 33/85 |
| 1,989,141 | 1/1935 | Leonard | 33/85 X |
| 2,761,214 | 9/1956 | Ruble | 33/85 |
| 2,949,673 | 8/1960 | Belcher | 33/85 |
| 3,063,152 | 11/1962 | Colbert | 33/85 |
| 3,104,468 | 9/1963 | Sarles | 33/85 |
| 3,349,494 | 10/1967 | Blake | 33/85 |

*Primary Examiner*—Charles E. Phillips
*Attorney, Agent, or Firm*—Sidney W. Millard

[57] ABSTRACT

A vertically extending rectangular pole which is designed for aligning courses of brick includes a pivotable arm which is attached to the lower end of the pole for nailing into a brick or mortar joint. The upper end of the pole includes a slideable nail bar which is adjustable relative to the pole to allow the nail bar to be nailed to insulation or external sheathing and to allow the pole to be adjusted to a plumb position.

2 Claims, 9 Drawing Figures

BRICK ALIGNMENT POLE

BACKGROUND OF THE INVENTION

This invention relates to a pole used by bricklayers to assist in properly locating courses of brick. Such poles have been used for many years and are called "dead men", presumably deriving their name from the fact that the pole takes the place of another man on the job but the pole does not exist in life.

Bricklayers use a unique "mason's rule" not unlike the well known folding scale used by carpenters. However, the mason's rule is calibrated and dimensioned somewhat differently in that it has a dimension approximately the height of one standard brick followed by the distance of one standard mortar joint followed by the height of another brick, etc. There may be slight modifications of the scale but the principle is the same. This particular rule allows the bricklayer to measure his "courses" to see whether or not they are rising properly without having to resort to exact dimensional calculations based on inches or centimeters.

Prior pole designs for assisting bricklayers often include such a mason's rule painted or engraved into the surface of the pole. Unfortunately, over the months of use of such a pole the mortar tends to collect on the pole and either fill the engraved area or cover the lines of the printing. The motar then has to be scraped off; and if the scale is painted on, the paint often comes off also. Accordingly, there is a need in the industry for a mechanism for attaching a replaceable scale directly to the pole, and this invention has supplied that need. Additionally, the resulting invention allows vertical adjustment of the scale without moving the pole itself.

Other existing "dead men" provide attachments for the top and bottom of the pole which are very accurate and very detailed in how the pole may be adjusted to be plumb with the wall of brick. Unfortunately, in laying a course of brick (or building a wall) the pole must be plumb in all directions; that is, 360°. The prior art is so complicated the operation requires four hands. Accordingly, there is a need in the industry for a very simple mechanism for locating a dead man pole which is plumb with respect to the wall and which can be mounted by a single workman. This invention has supplied that need.

SUMMARY OF THE INVENTION

The pole of this invention may be nailed to a construction wall and adjusted to plumb or vertical position with a minimum of effort and by a single workman. For the purpose of this invention, the term "construction wall" means the conventional wood-studding, wood-sheathing, non-wood paneling, masonry backup, or anything else over which a wall of facing brick would be installed. It is also intended to include that portion of a brick wall or foundation already in existence at the time of starting the work. In other words, "construction wall" includes the existing construction at the time of beginning to install the brick alignment pole.

The pole is preferably rectangular and has a pivotable arm attached at one face on the lower portion of the pole. The arm consists of 3/16 inches thick steel bar stock about 1½ inches wide and 6 inches long. The width and length are indeterminate in that they have no bearing on the inventive concept. They need only be adequate for receiving a nail driven into a brick or a mortar joint. However, the thickness of the arm is significant because it gives a proper spacing between the existing brick at the base of the wall and the position of the "line" extending between two such poles. The "line" is the string or cord used by bricklayers in properly locating the brick while laying a course. The line is approximately 1/16 inch thick and the brick is supposed to be laid with its outer face about ⅛ inch from the line. It is clear that ⅛ inch is a rough working estimate. The brick should never be in contact with the line because it will displace the line and the resulting wall will not be straight.

A nail bar designed to be nailed to the upper part of a construction wall includes a transversely projecting extension mounted near the top of the pole. The mounting is such that the nail bar can swing circumferentially through an angle of 360° in a plane perpendicular to the axis of the bar and can also be adjusted radially with respect to said axis. The means for mounting the pole in plumb position will be explained in detail in the description of the preferred embodiment.

Objects of the invention will become obvious from a detailed reading of the description of the preferred embodiment.

DESCRIPTION OF THE PREFERRED EMBODIMENT

Figure 1:
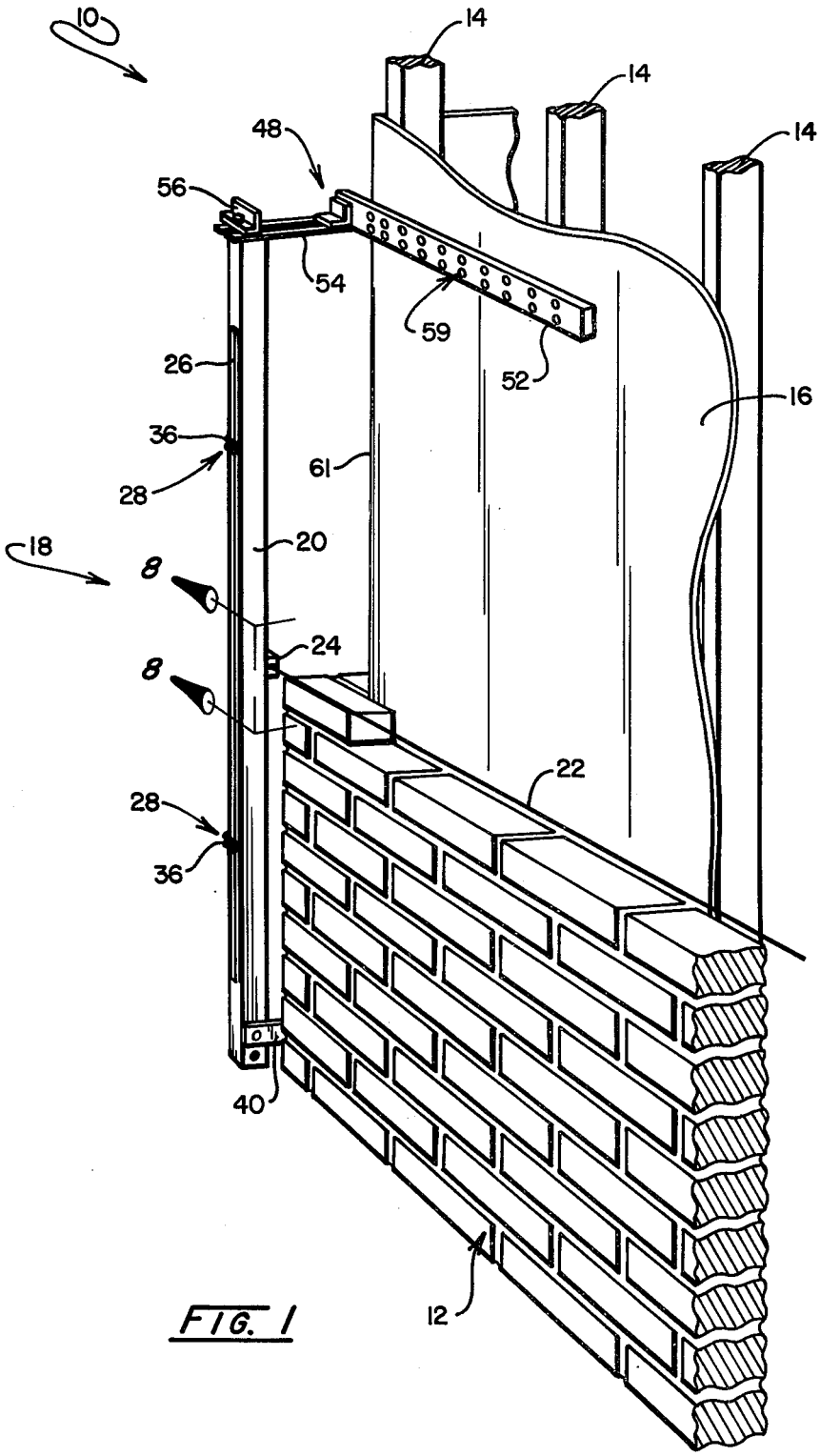
FIG. 1 is a perspective view of the pole of this invention showing the pole mounted in operable position on a construction wall.

This invention is designed to be used with a construction wall where the studding is already plumb and the construction wall indicated generally at 10 in FIG. 1 includes the brick 12, the studding 14 and the sheathing 16. It will be noted by those skilled in the art that even if the studding 14 is not plumb, the brick will be laid parallel with it. Thus, the resulting brick will be plumb with respect to the studding.

The invention comprises a dead man pole indicated generally at 18 and includes a rectangular, preferably metallic, pole 20 which in operable position has a vertically extending axis. As with other conventional dead man poles, there are attachments for the bottom and top of the pole, a mason's rule associated with the pole, and a line 22, and line block 24 operably associated with the pole.

Figure 2:
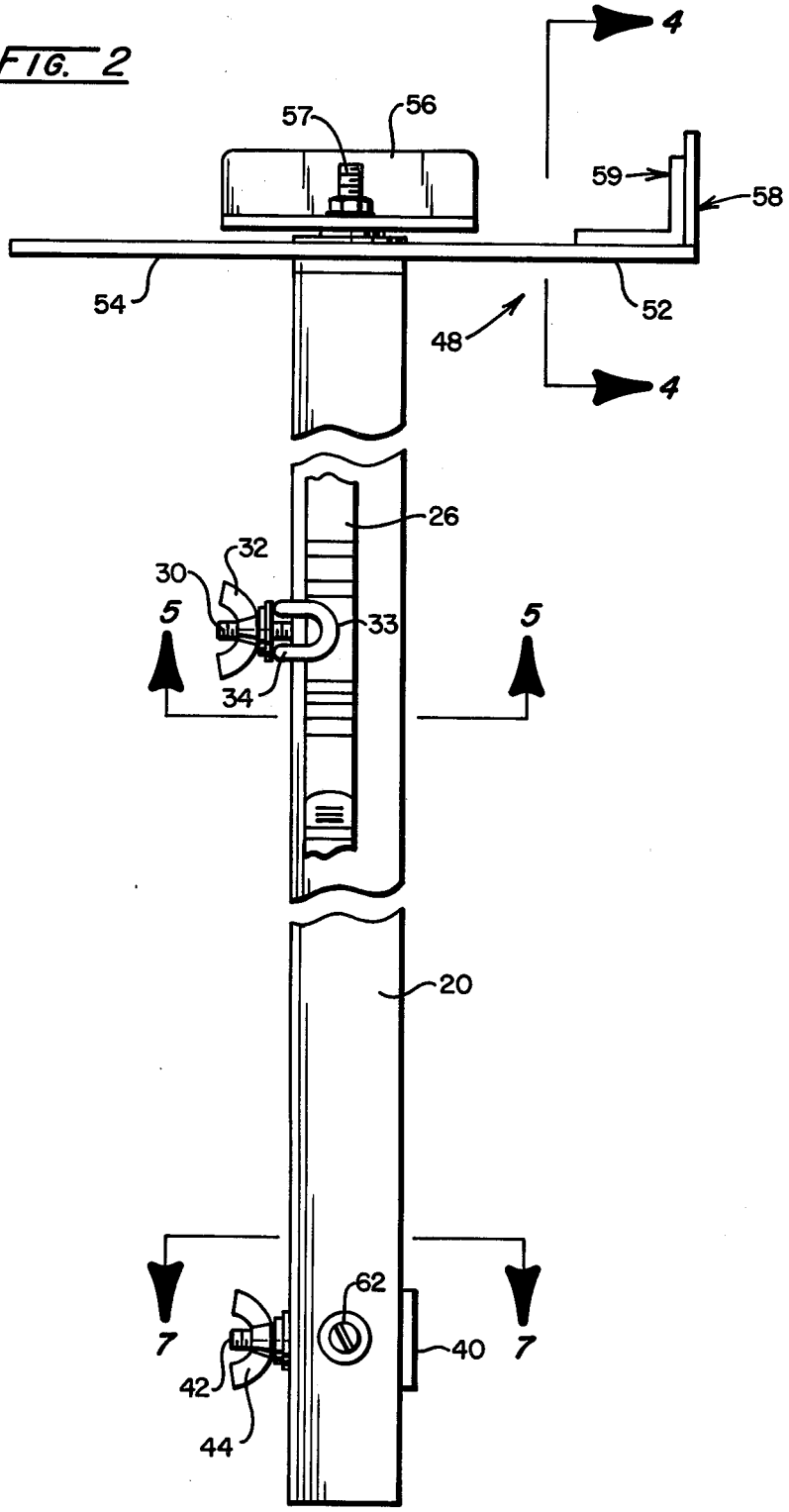
FIG. 2 is a broken elevational view of the pole of FIG. 1.
Figure 5:
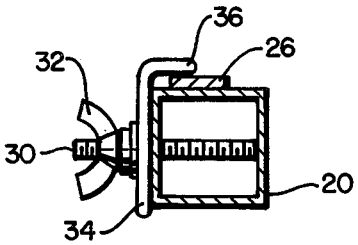
FIG. 5 is a sectional view of the pole taken along line 5—5 of FIG. 2.
Figure 6:
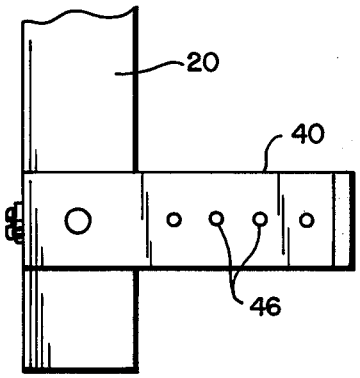
FIG. 6 is a fragmentary view of the lower end of the pole showing the arm extending perpendicular to the pole.
Figure 7:
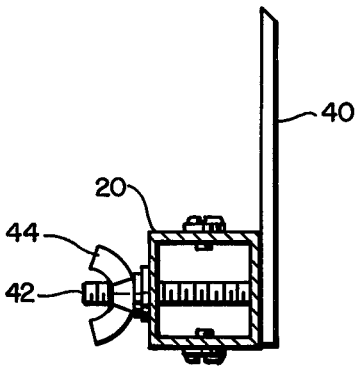
FIG. 7 is a sectional view of the pole taken along line 7—7 of FIG. 2.

The mason's rule 26 is a replaceable unit and is mounted on the pole by a unique set of clamping means, best illustrated in FIGS. 2 and 5. Each clamp includes a stud 30 with a mating wing nut 32 which tightens on clamp 34. Clamp 34 looks somewhat like a single link of a chain in that it is a circular rod bent into the form of a loop with the ends joined. One end of the closed loop is bent over at a right angle to form a toe 36 which holds the mason's rule against the pole 20.

Observing particularly FIG. 5, it will be noted that the wing nut 32 may be loosened and the clamp 34 retracted enough that it may be reversed and the mason's rule 26 may be mounted on the opposite side from where it is shown in FIG. 5.

Observing now FIGS. 1, 2, 6 and 7, an arm 40 is attached to the lower portion of the pole by a stud 42, preferably butt-welded to one face of the arm 40. Particularly noting FIG. 7, the stud 42 projects through openings in the pole 20 and extends to the opposite side where it is threadedly engaged with a wing nut 44. With the wing nut 44 loose, the arm 40 may pivot completely around 360° with respect to the pole; and with the wing nut tightened, the arm is rigidly held in position with respect to the pole. Four nail holes 46 are illustrated in the arm 40 in FIG. 6 but the number of holes is clearly optional.

At the upper end of the pole is a nail bar indicated generally at 48. It is designed to abut the face of the construction wall, and a plurality of nail holes 50 extend therethrough for receiving nails to be driven into the construction wall. The nail bar itself, 52, is designed to have its outer face abutting the construction wall and at one end thereof is a bifurcated extension 54. The extension 54 must extend at a right angle to the nail bar 52 and the extension should be identical in width to the pole 20. This is an important feature, in that, in mounting the pole, measurments are made from the face of the nail bar 52 which abuts the construction wall and from the edge of the extension 54 where it attaches to the nail bar 52. This will be explained in more detail subsequently as it relates to "plumbing" the pole.

Means are provided for attaching the nail bar and its extension to the upper portion of the pole, and preferably this includes a relatively large nut 56 threaded onto a stud 57 extending vertically from the top of the pole. The nut illustrated is made by a conventional hexagon nut which is welded around an aperture through an angle iron. This allows easy finger turning of the nut 56 and leverage to tighten the same. Obviously, the design of nut 56 is optional.

With the illustrated pole (and a duplicate mounted elsewhere) in operable position, the stone mason or bricklayer will mount a pair of line blocks 24 in place, based on the mason's rule 26, and will place the cord 22 in tension such that it will be held in place by friction. As indicated previously, if the pole is mounted correctly, there will be a $\frac{1}{8}$ inch horizontal clearance between the bricks being laid and the cord 22.

Figure 8:
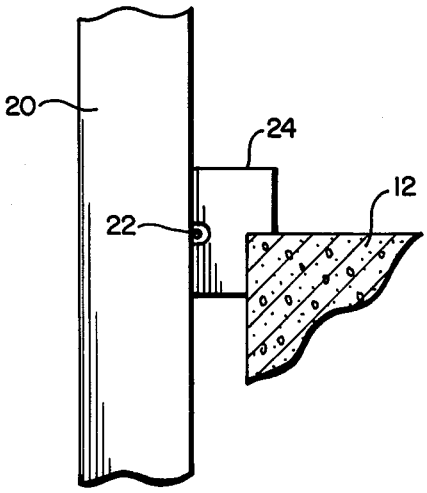
FIG. 8 is a fragmentary sectional view taken along line 8—8 of FIG. 1.
Figure 9:
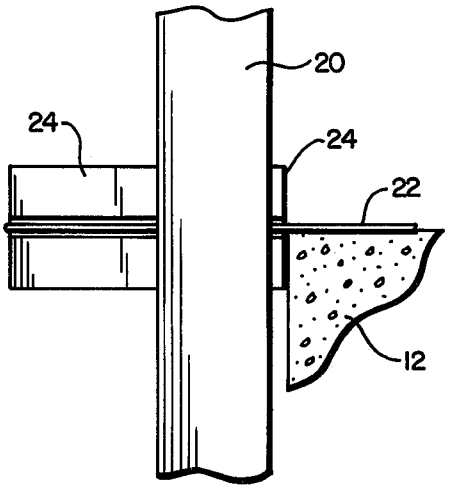
FIG. 9 is an elevational view of the apparatus of FIG. 8.

The location of the pole 20 and the placing of the line block 24 with respect to the uppermost brick 12 in FIG. 1 is misleading as they relate to the instant invention. But, the figure appears necessary for the overall showing. In this invention, the line block 24 is cut so that it extends 3/16 inch beyond the edge of the pole when it is in operable position. Therefore, the first laid brick 12 at the corner will abut the end of the line block as illustrated in FIGS. 8 and 9. Additionally, the cutting of the line block to this dimension is helpful in the mounting of the pole as will be explained subsequently.

As a general rule, there is more than one workman on a construction project, but this particular brick alignment pole is designed to allow the mounting by a single workman, and the procedures for mounting the individual poles are very simple.

The first thing one wishes to do is ascertain the size of the brick; and, if they are standard, then the mason's rule may be used without modification. However there are some generally recognized tolerances to be considered. For example, the bricks forming the wall will be placed about $\frac{5}{8}$ to $\frac{3}{4}$ inches from the sub-siding or sheathing 16. This spacing will allow the bricklayer to deposit the bricks on the layer of mortar in a vertical position. Specifically, it will allow his fingers to hold the brick for setting it in place with his fingers being between the inner face of the brick and the outer face of the sub-siding.

Figure 3:
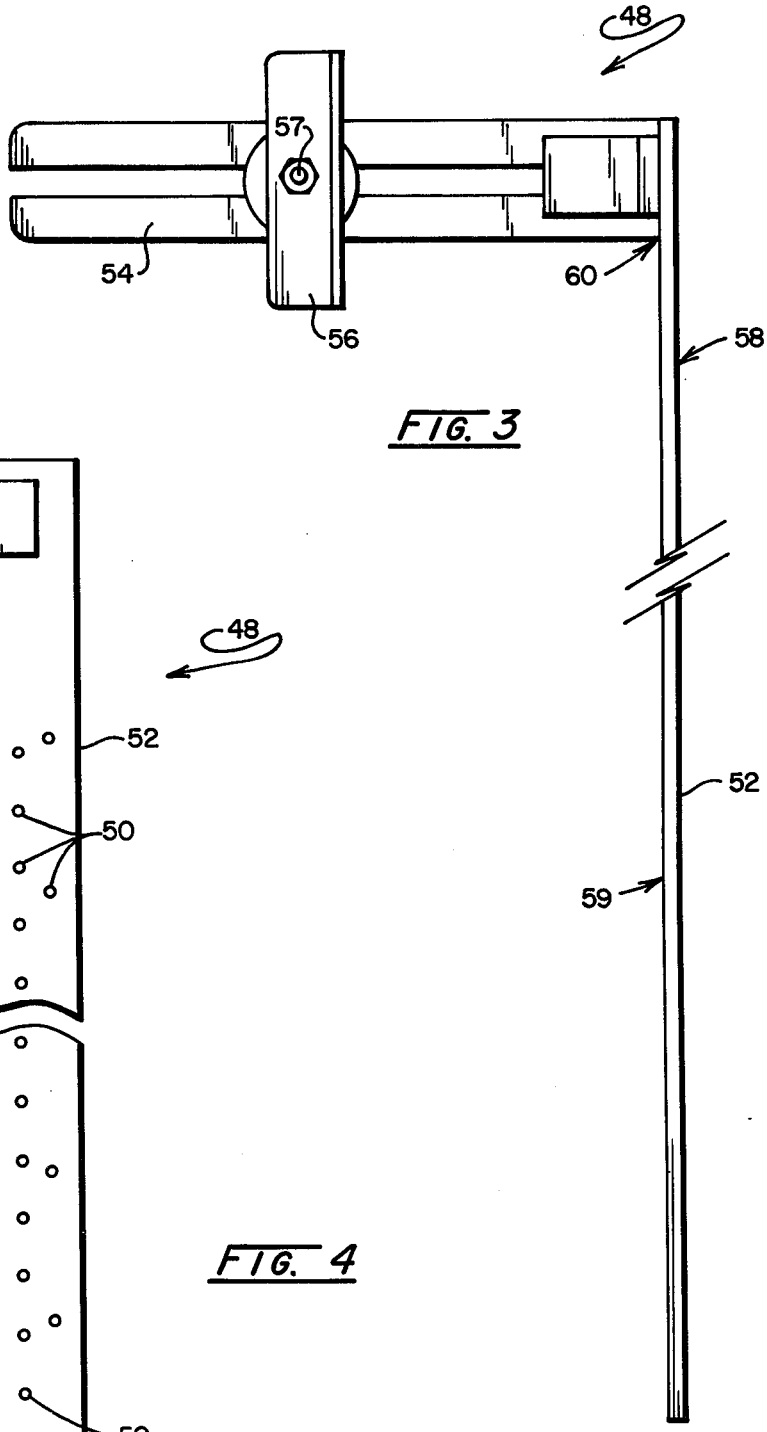
FIG. 3 is a plan view of the pole of FIG. 1, particularly illustrating the extending nail bar.
Figure 4:
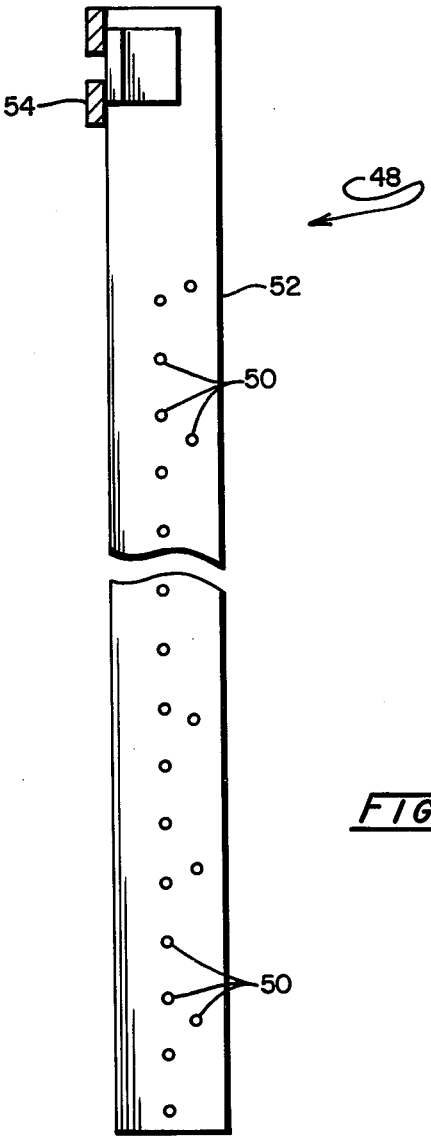
FIG. 4 is a sectional view of the nail bar taken along line 4—4 of FIG. 2.

Conventional bricks have a width of about $3\frac{7}{8}$ inches. Therefore, the outer face of the bricks will be approximately $4\frac{1}{2}$ inches from the face of the sub-siding 16. As previously indicated, the bricklayer wants his cord to be approximately $\frac{1}{8}$ inch from the outer face of the brick, and the cord itself is about 1/16 inch thick. Therefore, one who is mounting the pole wants the innermost face of the pole to be 4 11/16 inches from the outer face of the construction wall; that is, from the surface of the sub-siding 16. Obviously, for different size brick or spacing between the brick and the construction the measurement would be different from 4 11/16 inches. Accordingly, in mounting the pole, the first step is to orient the nail bar 52 in the proper direction, measure the distance — 4 11/16 inches — from the outer face 58 of the nail bar to the closest edge of the pole 20. Then a measurement would be made on the inner face 59 of the nail bar where the workman can see the mark (we assume the mark will be made with pencil but it could be a permanent mark if desired). The distance from the extension 54 measured from the point 60 along the nail bar (FIG. 3) must be an identical measurement of 4 11/16 inches. Note that because bifurcated extension 54 is the same width as the pole 20, measurement from point 60 is the same as a perpendicular measurement from the face of pole 20. The workman would align the corner 61 of the construction wall with the pencil mark on face 59 such that the two closest edges of the pole 20 would both be 4 11/16 inches from the plane of the construction wall, measured in each case perpendicular to the surface of the pole. The nut 56, of course, would be tightened on the stud 57 to hold the extension and nail bar in rigid position. Thereafter, the nail bar 52 will be nailed to the construction wall at approximately the proper height.

Next, the arm 40 will be rotated to the proper position so that one of the nail holes 46 aligns with a mortar joint and the arm may be nailed into place. As previously indicated, the thickness of the arm 40 is 3/16 inch. Thus, the proper spacing of the pole from the construction wall or brick face is automatic on the side where it is nailed. However, the spacing in the other direction is not automatic and it must be measured. Obviously, a simple ruler may be used to locate the pole at this lower position, but the line block 24 is specifically cut to extend beyond the face of the pole 3/16 inch. Therefore, before the line block is put in operable position with the line 22, it may be used to space the pole from the face of the brick without resorting to actually measuring the distance. The lower end of the pole and the line block may be held in place with the face of the line block abutting the face of the construction wall and the nail may be driven into the mortar joint through one of the nail holes 46.

It will be observed that the arm 40 need not be at right angles to the axis of the pole. This allows for adjustment to accommodate the approximate height in the nailing of the nail bar 52. The wing nut 44 may be loosened and the arm 40 pivoted to the proper position. After arm 40 is in position, the wing nut can be tightened again to lock the arm 40 in position relative to the pole.

While it is not shown in the drawings, there are occasions to use the pole 20 intermediate the corners of a wall, and for such instances screw heads 62 (FIG. 2) at the lower portion of the pole are provided. Arm 40 would slide into an unfilled mortar space between bricks until the screw head 62 abutted the face of the brick. One screw head 62 is provided on each of the pole faces not used by the arm 40 and stud 42. The screw heads project 3/16 inch and thus provide automatic spacing for the pole to accommodate the line 22.

Having thus described the preferred embodiment, it will be obvious to those having ordinary skill in the art that certain modifications may be made without departing from the spirit of the inventive concept. Accordingly, it is not the intention of the inventor to be limited by the drawings nor the language used to describe the invention. Rather, it is intended that the scope of the invention be limited only by the appended claims.

I claim:

1. A pole for aligning courses of brick of a brick wall being constructed as a facing for a building structure construction wall comprising:

a hollow rectangular pole having no more than three adjusting means comprising an arm, a nail bar and a rule, the pole being of extended length having a vertical axis in operable position;

the arm being attached to the lower portion of said pole;

means for pivotally attaching the arm to the pole for pivoting the arm at times about a horizontal axis with respect to said pole and for rigidly holding the arm at times in place with respect to said pole;

means for attaching said arm to the end of said brick wall;

the nail bar being of substantial length and slidably attached near the upper end of the pole by a transversely projecting extension of said nail bar and means for rigidly clamping the extension to the pole and for allowing the extension to slide to other positions;

means for securing said nail bar to said building structure construction wall so that the connection of the bar to the extension is beyond the end of said construction wall;

means for attaching the rule, said rule being a vertically adjustable removable mason's rule attached along one side of the pole with said rule extending generally parallel to said vertical axis and for allowing the rule to be adjusted vertically on the pole, said attaching means comprising screws threaded into the pole and clamps held by said screws and extending over the rule whereby tightening the screws will cause the clamps to lock the rule in place with respect to said pole;

said rule having a plurality of measurements engraved thereon including measurements indicating the depth of one brick and interposed between such measurements of one brick in each case and measurement of the spacing between the bricks and the mortar layer for the bricks;

the nail bar being adjustable relative to the pole axis in the two dimensions of a plane perpendicular to the axis;

the extension of the nail bar being bifrucated to slide on each side of the attaching means, said attachment means comprising a threaded nut connected to a stud on the pole.

2. The pole of claim 1 wherein the arm is a piece of metal having a height and a length of indefinite dimensions and a thickness of 3/16 inches;

at least one hole extending through the thickness of 3/16 inches.

* * * * *